US012698914B2

(12) United States Patent
Miura et al.

(10) Patent No.: US 12,698,914 B2
(45) Date of Patent: Aug. 4, 2026

(54) REFRIGERATION CYCLE DEVICE AND REFRIGERANT LEAKAGE DETERMINATION SYSTEM

(71) Applicant: DAIKIN INDUSTRIES, LTD., Osaka (JP)

(72) Inventors: Shu Miura, Osaka (JP); Keisuke Nishitani, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 93 days.

(21) Appl. No.: 18/514,442

(22) Filed: Nov. 20, 2023

(65) Prior Publication Data

US 2024/0085042 A1 Mar. 14, 2024

Related U.S. Application Data

(63) Continuation of application No. PCT/JP2022/020672, filed on May 18, 2022.

(30) Foreign Application Priority Data

May 21, 2021 (JP) ..... 2021-086499

(51) Int. Cl.
*F24F 11/36* (2018.01)
*F24F 11/58* (2018.01)
(Continued)

(52) U.S. Cl.
CPC ..... *F24F 11/36* (2018.01); *F24F 11/58* (2018.01); *F24F 2110/12* (2018.01);
(Continued)

(58) Field of Classification Search
CPC ..... F24F 11/36; F24F 11/58; F24F 2110/12; F24F 2120/10; F24F 2140/20; F24F 2221/22; F25B 2500/222
See application file for complete search history.

(56) References Cited

U.S. PATENT DOCUMENTS

2008/0209926 A1 9/2008 Matsuoka et al.
2017/0268811 A1 9/2017 Ochiai et al.
2018/0051922 A1 2/2018 Ochiai et al.

FOREIGN PATENT DOCUMENTS

EP 0719995 A2 * 7/1996 ..... C04B 41/52
JP 2001-241725 A 9/2001
(Continued)

OTHER PUBLICATIONS

KR 2009-0085888 (English translation) (Year: 2009).*
(Continued)

*Primary Examiner* — Jonathan Bradford
(74) *Attorney, Agent, or Firm* — Birch, Stewart, Kolasch & Birch, LLP

(57) ABSTRACT

An air conditioner has a heat source unit and a utilization unit, and includes a refrigerant circuit, a first detector, and a controller. The refrigerant circuit is configured by a compressor, a condenser, an expansion mechanism, and an evaporator being connected by a refrigerant pipe. The first detector detects the temperature or pressure of refrigerant in the refrigerant circuit. The controller starts the compressor during the non-operation of the compressor and executes a determination mode to determine the presence or absence of refrigerant leakage from the refrigerant circuit on the basis of a detection value of the first detector.

15 Claims, 5 Drawing Sheets

(51) Int. Cl.

| | |
|---|---|
| *F24F 110/12* | (2018.01) |
| *F24F 120/10* | (2018.01) |
| *F24F 140/12* | (2018.01) |
| *F24F 140/20* | (2018.01) |

(52) U.S. Cl.
CPC ..... *F24F 2120/10* (2018.01); *F24F 2140/12* (2018.01); *F24F 2140/20* (2018.01); *F24F 2221/22* (2013.01); *F25B 2500/222* (2013.01)

(56) References Cited

FOREIGN PATENT DOCUMENTS

| | | | |
|---|---|---|---|
| JP | 2006-58007 | A | 3/2006 |
| JP | 2008-96051 | A | 4/2008 |
| JP | 2010-7996 | A | 1/2010 |
| JP | 2017-20766 | A | 1/2017 |
| JP | 6257801 | B2 | 1/2018 |
| JP | 2018-132235 | A | 8/2018 |
| WO | WO 2019/021346 | A1 | 1/2019 |

OTHER PUBLICATIONS

CN 10959741 (English translation) (Year: 2019).*
International Search Report for PCT/JP2022/020672 mailed on Jul. 12, 2022.
International Preliminary Report on Patentability and English translation of the Written Opinion of the International Searching Authority for International Application No. PCT/JP2022/020672, dated Nov. 30, 2023.
Extended European Search Report for European Application No. 22804717.1, dated Nov. 14, 2024.

* cited by examiner

REFRIGERATION CYCLE DEVICE AND REFRIGERANT LEAKAGE DETERMINATION SYSTEM

CROSS REFERENCE TO RELATED APPLICATIONS

This application is a Continuation of PCT International Application No. PCT/JP2022/020672, filed on May 18, 2022, which claims priority under 35 U.S.C. § 119(a) to Patent Application No. JP 2021-086499, filed in Japan on May 21, 2021, all of which are hereby expressly incorporated by reference into the present application.

TECHNICAL FIELD

The present disclosure relates to a refrigeration cycle device and a refrigerant leakage determination system.

BACKGROUND ART

Conventionally, in a refrigeration cycle device, there is known a method for determining refrigerant leakage from changes in pressure or temperature during a refrigeration cycle is stopped (Patent Literature 1 (JP 6257801 B2)).

SUMMARY

A refrigeration cycle device according to a first aspect has a heat source unit and a utilization unit, and includes a refrigerant circuit, a first detector, and a control unit. The refrigerant circuit is configured by a compressor, a condenser, an expansion mechanism, and an evaporator being connected by a refrigerant pipe. The first detector detects a temperature or pressure of refrigerant in the refrigerant circuit. The control unit starts the compressor during non-operation of the compressor and executes a determination mode to determine the presence or absence of refrigerant leakage from the refrigerant circuit on the basis of a detection value of the first detector.

DESCRIPTION OF EMBODIMENT

A refrigerant cycle device according to the present disclosure will be described hereinafter with reference to the drawings.

(1) Overall Configuration

Figure 1:
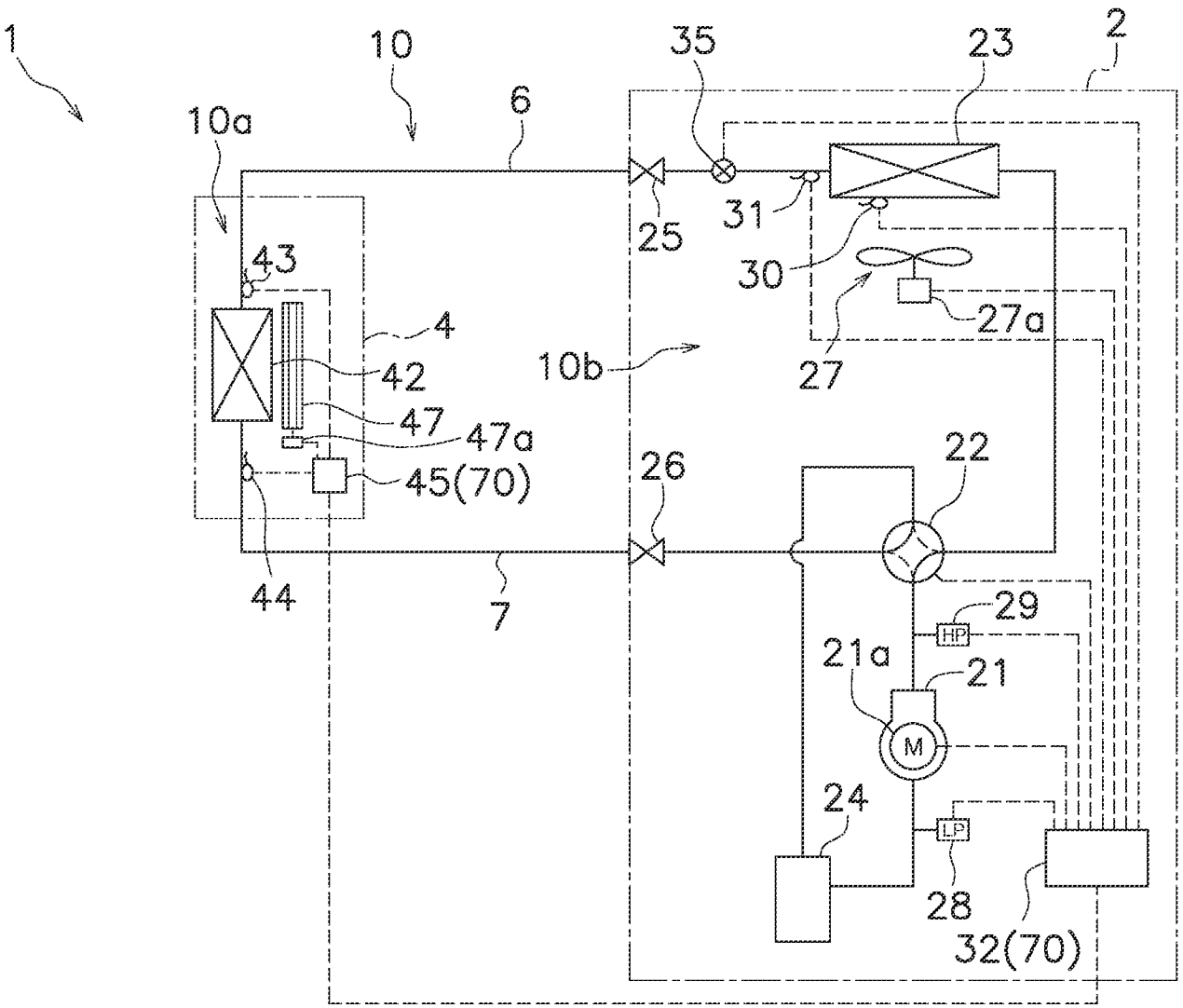
FIG. 1 is a schematic refrigerant circuit diagram of an air conditioner.

FIG. 1 is a schematic refrigerant circuit diagram of an air conditioner 1 which exemplifies a refrigeration cycle device according to the present disclosure. The air conditioner 1 is a device used for indoor cooling and heating of a building or the like by vapor compression refrigeration cycle operation. The air conditioner 1 mainly includes a single heat source unit 2, a single utilization unit 4, and a liquid-refrigerant connection pipe 6 and gas-refrigerant connection pipe 7 each connecting the heat source unit 2 to the utilization unit 4.

A vapor compression refrigerant circuit 10 for the air conditioner 1 according to the present embodiment is configured by connecting the heat source unit 2, the utilization unit 4, the liquid-refrigerant connection pipe 6, and the gas-refrigerant connection pipe 7. Note that the utilization unit need not be a single unit, but may be a plurality of utilization units.

(2) Detailed Configuration (2-1) Utilization Unit

The utilization unit 4 is installed by being embedded in or suspended from an indoor ceiling in a building or the like, or by being hung on an indoor wall surface. The utilization unit 4 is connected to the heat source unit 2 via the liquid-refrigerant connection pipe 6 and the gas-refrigerant connection pipe 7, and constitutes a part of the refrigerant circuit 10.

The configuration of the utilization unit 4 will be described.

The utilization unit 4 mainly includes a utilization-side refrigerant circuit 10*a* constituting a part of the refrigerant circuit 10. The utilization-side refrigerant circuit 10*a* mainly includes a utilization-side heat exchanger 42.

In the present embodiment, the utilization-side heat exchanger 42, which is a cross-fin type fin-and-tube heat exchanger including a heat transfer tube and a large number of fins, functions as an evaporator for the refrigerant to cool indoor air during cooling operation, and functions as a condenser for the refrigerant to heat indoor air during heating operation.

In the present embodiment, the utilization unit 4 includes a utilization fan 47 for sucking indoor air into the unit and supplying the air, after heat exchange, as supply air to the interior, and is capable of exchange heat between the indoor air and the refrigerant flowing through the utilization-side heat exchanger 42. The utilization fan 47 is capable of varying the flow rate of air supplied to the utilization-side heat exchanger 42, and is a cross-flow fan driven by a fan motor 47*a* in the present embodiment. The utilization fan 47 is operated in a rotational speed range between first rotational speed (maximum rotational speed) and second rotational speed (minimum rotational speed). In the present embodiment, the first rotational speed of the utilization fan 47 is 800 rpm, and the second rotational speed is 1200 rpm. A control unit 70 can change the airflow rate of the utilization fan 47 in steps. The relationship between the rotational speed and the airflow rate at each stage is set, for example, as follows: the airflow rate of fan tap L at a rotational speed of 800 rpm, the airflow rate of fan tap LM at a rotational speed of 900 rpm, the airflow rate of fan tap M at a rotational speed of 1000 rpm, the airflow rate of fan tap HM at a rotational speed of 1100 rpm, and the airflow rate of fan tap H at a rotational speed of 1200 rpm. Therefore, the airflow rate of the fan tap L is the lowest, and the airflow rate of the fan tap H is the highest.

The utilization unit 4 is also provided with various sensors. A liquid-side temperature sensor 43 that detects the temperature of the refrigerant in the liquid state or the gas-liquid two-phase state is provided on the liquid side of the utilization-side heat exchanger 42. A gas-side temperature sensor 44 that detects the temperature of the refrigerant in the gas state or the gas-liquid two-phase state is provided on the gas side of the utilization-side heat exchanger 42. In the present embodiment, the liquid-side temperature sensor 43 and the gas-side temperature sensor 44 are thermistors. The liquid-side temperature sensor 43 and the gas-side temperature sensor 44 exemplify a first detector in the claims, which detects the temperature or pressure of the refrigerant in the refrigerant circuit 10.

The utilization unit 4 also includes a utilization-side control unit 45 that controls the operation of each component constituting the utilization unit 4. In addition, the utilization-side control unit 45 has a microcomputer, a memory, and the like provided for controlling the utilization unit 4, and can exchange control signals and the like with a remote controller (not illustrated) for individually operating the utilization unit 4 and exchange control signals and the like with a heat source control unit 32 of the heat source unit 2 described later. The utilization-side control unit 45, and the heat source-side control unit 32 to be described later, work together to function as the control unit 70 that controls the operation of each component of the air conditioner 1. The control unit 70 will be described later.

(2-2) Heat Source Unit

The heat source unit 2 is installed on the rooftop of a building or the like, is connected to the utilization unit 4 via the liquid-refrigerant connection pipe 6 and the gas-refrigerant connection pipe 7, and constitutes the refrigerant circuit 10 with the utilization unit 4.

Next, the configuration of the heat source unit 2 will be described. The heat source unit 2 mainly includes a heat source-side refrigerant circuit 10*b* that constitutes a part of the refrigerant circuit 10. The heat source-side refrigerant circuit 10*b* mainly includes a compressor 21, a four-way switching valve 22, a heat source-side heat exchanger 23, an accumulator 24, a liquid-side shutoff valve 25, a gas-side shutoff valve 26, and an expansion valve 35.

The compressor 21 is variable in operating capacity, and, in the present embodiment, is a positive displacement compressor driven by a motor 21*a* that is controlled by an inverter. In the present embodiment, there is only one compressor 21, but the present disclosure is not limited thereto, and two or more compressors may be connected in parallel according to the number of utilization units connected or the like.

The four-way switching valve 22 switches the flow direction of the refrigerant. During cooling operation, the four-way switching valve 22 connects the discharge side of the compressor 21 to the gas side of the heat source-side heat exchanger 23, and also connects the suction side (specifically, the accumulator 24) of the compressor 21 to the gas-refrigerant connection pipe 7 (seethe solid line of the four-way switching valve 22 in FIG. 1). As a result, the heat source-side heat exchanger 23 functions as a condenser for the refrigerant compressed by the compressor 21 and the utilization-side heat exchanger 42 functions as an evaporator for the refrigerant condensed by the heat source-side heat exchanger 23. During heating operation, the four-way switching valve 22 connects the discharge side of the compressor 21 to the gas-refrigerant connection pipe 7, and also connects the suction side of the compressor 21 and the gas side of the heat source-side heat exchanger 23 (see the broken lines of the four-way switching valve 22 in FIG. 1). As a result, the utilization-side heat exchanger 42 functions as a condenser for the refrigerant compressed by the compressor 21, and the heat source-side heat exchanger 23 functions as an evaporator for the refrigerant condensed by the utilization-side heat exchanger 42.

In the present embodiment, the expansion valve 35 is an electronic expansion valve with a variable opening degree, connected to the liquid side of the heat source-side heat exchanger 23 so as to adjust the flow rate of the refrigerant flowing through the liquid-refrigerant connection pipe 6.

In the present embodiment, the heat source-side heat exchanger 23, which is a cross-fin type fin-and-tube heat exchanger including a heat transfer tube and a large number of fins, functions as a condenser for the refrigerant during cooling operation and functions as an evaporator for the refrigerant during heating operation. The heat source-side heat exchanger 23 has the gas side connected to the four-way switching valve 22 and the liquid side connected to the liquid-refrigerant connection pipe 6.

In the present embodiment, the heat source unit 2 includes a heat source fan 27 for sucking outdoor air into the unit, supplying the outdoor air to the heat source-side heat exchanger 23, and then discharging the outdoor air outdoors, and is capable of exchange heat between the outdoor air and the refrigerant flowing through the heat source-side heat exchanger 23. The heat source fan 27 is capable of varying the flow rate of air supplied to the heat source-side heat exchanger 23, and is a propeller fan driven by a fan motor 27*a* in the present embodiment.

The accumulator 24 is connected between the four-way switching valve 22 and the compressor 21, and is a container capable of accumulating excess refrigerant generated in the refrigerant circuit 10 in accordance with the operating load of the utilization unit 4.

The liquid-side shutoff valve 25 and the gas-side shutoff valve 26 are provided at connecting ports to external equipment and pipes (specifically, the liquid-refrigerant connection pipe 6 and the gas-refrigerant connection pipe 7). The liquid-side shutoff valve 25 is connected to the heat source-side heat exchanger 23 via a pipe. The gas-side shutoff valve 26 is connected to the four-way switching valve 22 via a pipe.

Furthermore, the heat source unit 2 is provided with various sensors. Specifically, the heat source unit 2 is provided with a suction pressure sensor 28 that detects the suction pressure of the compressor 21, a discharge pressure sensor 29 that detects the discharge pressure of the compressor 21, a heat exchange temperature sensor 30 that detects the temperature of the refrigerant flowing in the heat source-side heat exchanger 23, and a liquid-side temperature sensor 31 that detects the temperature of the refrigerant in the liquid state or the gas-liquid two-phase state on the liquid side of the heat source-side heat exchanger 23. The suction pressure sensor 28, the discharge pressure sensor 29, the heat exchange temperature sensor 30, and the liquid-side temperature sensor 31 serve as a first detector in the claims, which detects the temperature or pressure of the refrigerant in the refrigerant circuit 10.

The heat source unit 2 also includes the heat source-side control unit 32 that controls the operation of each component constituting the heat source unit 2. In addition, the heat source-side control unit 32 has a microcomputer provided for controlling the heat source unit 2, a memory, an inverter circuit for controlling the motor 21*a*, and the like. The heat source-side control unit 32 can exchange control signals and the like with the utilization-side control unit 45 of the utilization unit 4. The heat source-side control unit 32 and the utilization-side control unit 45 work together to function as the control unit 70 that controls the operation of each component of the air conditioner 1. The control unit 70 will be described later.

As described above, the utilization-side refrigerant circuit 10*a*, the heat source-side refrigerant circuit 10*b*, and the refrigerant connection pipes 6 and 7 are connected to constitute the refrigerant circuit 10 of the air conditioner 1. In addition, the air conditioner 1 according to the present embodiment switches between the cooling operation and the heating operation by means of the four-way switching valve 22 to perform the operation, and controls each equipment of the heat source unit 2 and the utilization unit 4 in accordance with the operating load of the utilization unit 4.

(2-3) Control Unit

The control unit 70 includes the utilization-side control unit 45 and the heat source-side control unit 32.

The control unit 70 controls the operation of the air conditioner 1. For example, the control unit 70 controls the operation of the four-way switching valve 22 to switch to a state in which the heat source-side heat exchanger 23 functions as a condenser and the utilization-side heat exchanger 42 functions as an evaporator during the cooling operation. Furthermore, the control unit 70 controls the operation of the four-way switching valve 22 to switch to a state in which the heat source-side heat exchanger 23 functions as an evaporator and the utilization-side heat exchanger 42 functions as a condenser during the heating operation. Furthermore, the control unit 70 adjusts the rotational speed of the fan motor 47*a* of the utilization fan 47 and the fan motor 27*a* of the heat source fan 27. The control unit 70 also adjusts the opening degree of the expansion valve 35. Furthermore, the control unit 70 executes a determination mode for determining the presence or absence of refrigerant leakage from the refrigerant circuit 10 on the basis of the detection value of the first detector. The control unit 70 starts the compressor 21 during the non-operation of the compressor 21 and executes the determination mode. The non-operation of the compressor 21 includes, for example, a case where there is no operation signal input to the air conditioner 1, a so-called thermo-off state in which the compressor 21 stops due to a small cooling/heating load (temperature difference between the set temperature and room temperature), and a so-called air blowing operation state in which the compressor 21 is not operated but the utilization fan 47 is operated.

The control unit 70 is implemented by a computer. The control unit 70 has a control calculation device and a storage device (not illustrated). As the control calculation device, processors such as CPUs can be used. The control calculation device reads a program stored in the storage device and performs predetermined calculation processing in accordance with the program. Further, the control calculation device can write a calculation result to the storage device and read information stored in the storage in accordance with the program. The storage device can be used as a database.

The control unit 70 executes the determination mode even if the air conditioner 1 has not been operated for a predetermined time period. In the present embodiment, the control unit 70 performs the determination mode once a day.

(3) Overall Operation

Next, the operation of the air conditioner 1 according to the present embodiment will be described.

The operating mode of the air conditioner 1 according to the present embodiment includes a normal operating mode in which each equipment of the heat source unit 2 and the utilization unit 4 is controlled in accordance with the operation load of the utilization unit 4, and a determination mode in which the presence or absence of refrigerant leakage from the refrigerant circuit 10 is determined. In addition, the normal operating mode includes cooling operation and heating operation. In the determination mode according to the present embodiment, the control unit 70 detects the degree of subcooling of the refrigerant at the outlet of the heat source-side heat exchanger 23 functioning as the condenser, while operating the air conditioner 1 in a cooling operation state, to determine the presence or absence of refrigerant leakage from the refrigerant circuit 10.

(4) Operation of Air Conditioner in Each Operating Mode

Hereinafter, the operation of the air conditioner 1 in each operating mode will be described.

(4-1) Normal Operating Mode (4-1-1) Cooling Operation

First, the cooling operation in the normal operating mode will be described.

During the cooling operation, the four-way switching valve 22 is in the state indicated by the solid lines in FIG. 1, in other words, the discharge side of the compressor 21 is connected to the gas side of the heat source-side heat exchanger 23. Furthermore, the liquid-side shutoff valve 25 and the gas-side shutoff valve 26 are brought into an open position, and the opening degree of the expansion valve 35 is adjusted such that the degree of subcooling of the refrigerant at the outlet of the heat source-side heat exchanger 23 becomes a predetermined value. In the present embodiment, the degree of subcooling of the refrigerant at the outlet of the heat source-side heat exchanger 23 is detected by converting the discharge pressure value of the compressor 21 detected by the discharge pressure sensor 29 into a refrigerant saturation temperature value and subtracting the refrigerant temperature value detected by the liquid-side temperature sensor 31 from the refrigerant saturation temperature value. Alternatively, the degree of subcooling of the refrigerant at the outlet of the heat source-side heat exchanger 23 may be detected by subtracting the refrigerant temperature value detected by the liquid-side temperature sensor 31 from the refrigerant temperature value detected by the heat exchange temperature sensor 30 that detects the temperature of the refrigerant flowing in the heat source-side heat exchanger 23. When the compressor 21 is started in this state of the refrigerant circuit 10, low-pressure gas refrigerant is sucked into the compressor 21 and compressed into high-pressure gas refrigerant. Then the high-pressure gas refrigerant is sent to the heat source-side heat exchanger 23 via the four-way switching valve 22, is condensed through heat exchange with outdoor air supplied by the heat source fan 27, and becomes high-pressure liquid refrigerant.

The high-pressure liquid refrigerant is decompressed by the expansion valve 35 into a low-pressure gas-liquid two-phase state. The low-pressure refrigerant in the gas-liquid two-phase state is then sent to the utilization-side heat exchanger 42 via the liquid-side shutoff valve 25 and the liquid-refrigerant connection pipe 6, is evaporated through heat exchange with the indoor air supplied by the utilization fan 47 in the utilization-side heat exchanger 42, and becomes low-pressure gas refrigerant.

Here, since the expansion valve 35 controls the flow rate of the refrigerant flowing through the heat source-side heat exchanger 23 so that the degree of subcooling at the outlet of the heat source-side heat exchanger 23 becomes a predetermined value, the high-pressure gas refrigerant after condensation in the heat source-side heat exchanger 23 has a predetermined degree of subcooling. In addition, in the utilization-side heat exchanger 42, the refrigerant flows at a flow rate corresponding to the operating load required in the air conditioned space where the utilization unit 4 is installed.

The low-pressure gas refrigerant is sent to the heat source unit 2 via the gas-refrigerant connection pipe 7, and flows into the accumulator 24 via the gas-side shutoff valve 26 and the four-way switching valve 22. Then the low-pressure gas refrigerant flowing into the accumulator 24 is again sucked into the compressor 21. Here, when an excess amount of refrigerant is generated in the refrigerant circuit 10 in accordance with the operating load of the utilization unit 4, such as when the utilization unit 4 is stopped or when the operating load of the utilization unit 4 is small, the excess refrigerant is accumulated in the accumulator 24.

(4-1-2) Heating Operation

Next, the heating operation in the normal operating mode will be described.

During the heating operation, the four-way switching valve 22 is in the state indicated by the broken lines in FIG. 1, in other words, the discharge side of the compressor 21 is connected to the gas side of the utilization-side heat exchanger 42, and the suction side of the compressor 21 is connected to the gas side of the heat source-side heat exchanger 23. Furthermore, the liquid-side shutoff valve 25 and the gas-side shutoff valve 26 are brought into an open position, and the opening degree of the expansion valve 35 is adjusted such that the degree of subcooling of the refrigerant at the outlet of the utilization-side heat exchanger 42 becomes a predetermined value. In the present embodiment, the degree of subcooling of the refrigerant at the outlet of the utilization-side heat exchanger 42 is detected by converting the discharge pressure value of the compressor 21 detected by the discharge pressure sensor 29 into a refrigerant saturation temperature value and subtracting the refrigerant temperature value detected by the liquid-side temperature sensor 43 from the refrigerant saturation temperature value. Note that although not employed in the present embodiment, a temperature sensor that detects the temperature of the refrigerant flowing in the utilization-side heat exchanger 42 may be provided, and the degree of subcooling of the refrigerant at the outlet of the utilization-side heat exchanger 42 may be detected by subtracting the refrigerant temperature value detected by the liquid-side temperature sensor 43 from the refrigerant temperature value detected by the temperature sensor.

When the compressor 21 is started in this state of the refrigerant circuit 10, low-pressure gas refrigerant is sucked into the compressor 21 and compressed into high-pressure gas refrigerant, and sent to the utilization unit 4 via the four-way switching valve 22, the gas-side shutoff valve 26, and the gas-refrigerant connection pipe 7.

Then the high-pressure gas refrigerant sent to the utilization unit 4 is condensed through heat exchange with indoor air supplied by the utilization fan 47 in the utilization-side heat exchanger 42, and becomes high-pressure liquid refrigerant.

The high-pressure liquid refrigerant is sent to the heat source unit 2 via the liquid-refrigerant connection pipe 6, and flows into the expansion valve 35 via the liquid-side shutoff valve 25. The high-pressure liquid refrigerant is decompressed by the expansion valve 35 into a low-pressure gas-liquid two-phase state. Here, since the expansion valve 35 controls the flow rate of the refrigerant flowing through the utilization-side heat exchanger 42 so that the degree of subcooling at the outlet of the utilization-side heat exchanger 42 becomes a predetermined value, the high-pressure liquid refrigerant after condensation in the utilization-side heat exchanger 42 has a predetermined degree of subcooling. In addition, in the utilization-side heat exchanger 42, the refrigerant flows at a flow rate corresponding to the operating load required in the air conditioned space where the utilization unit 4 is installed.

The low-pressure refrigerant in the gas-liquid two-phase state flows into the heat source-side heat exchanger 23. Then the low-pressure gas-liquid two-phase refrigerant that has flowed into the heat source-side heat exchanger 23 is condensed through heat exchange with outdoor air supplied by the heat source fan 27 to become low-pressure gas refrigerant, and flows into the accumulator 24 via the four-way switching valve 22. Then the low-pressure gas refrigerant flowing into the accumulator 24 is again sucked into the compressor 21. Here, when an excess amount of refrigerant is generated in the refrigerant circuit 10 in accordance with the operating load of the utilization unit 4, such as when the utilization unit 4 is stopped or when the operating load of the utilization unit 4 is small, the excess refrigerant is accumulated in the accumulator 24 as in the cooling operation.

(4-2) Determination Mode

Next, the determination mode will be described.

The control unit 70 executes the determination mode every predetermined period, for example, once a day.

When the air conditioner 1 is operating in the normal operating mode, the control unit 70 executes the determination mode during intervals between the normal operating modes.

Figure 2:
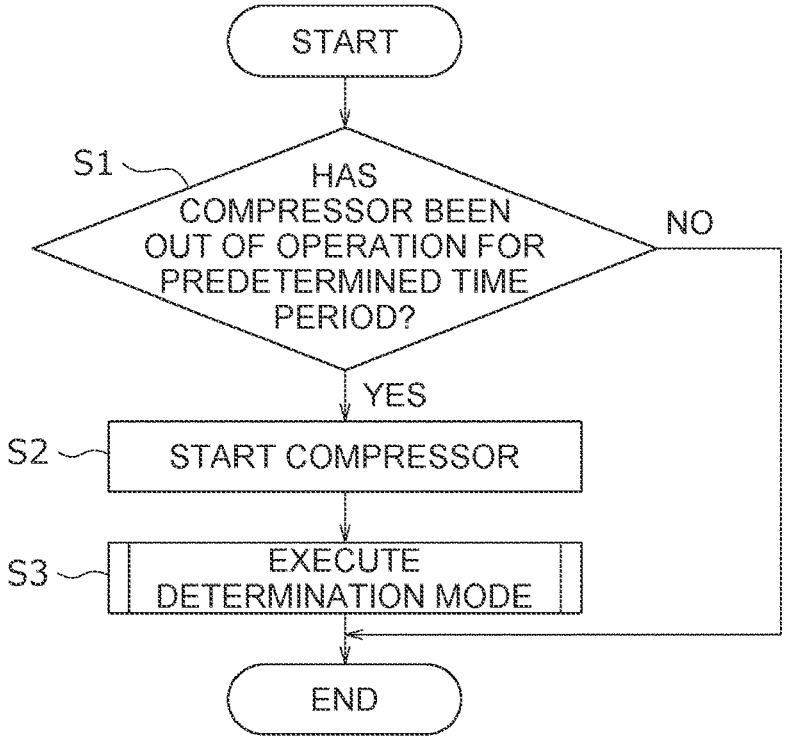
FIG. 2 is a flowchart exemplifying a procedure for executing a determination mode.

If the compressor 21 has been out of operation for a long time, the control unit 70 forcibly starts the compressor 21 once a day to execute the determination mode. Cases where the compressor 21 is out of operation for a long time include, for example, not only the case where the air conditioner 1 is out of operation, but also the case where the compressor 21 is stopped due to a small cooling/heating load, and the case where the compressor 21 is stopped and only the utilization fan 47 is operating. Thus, the control unit 70 can reliably execute the determination mode every predetermined period. Here, a procedure for executing the determination mode by the control unit 70 when the compressor 21 is stopped for a predetermined time period will be described with reference to the flowchart in FIG. 2.

First, in step S1, the control unit 70 determines whether or not the compressor 21 is out of operation for a predetermined time period. The predetermined time period is appropriately determined such that, for example, even if compressor 21 is stopped for a long time, control unit 70 executes the determination mode once a day. For example, if the compressor 21 is out of operation from 0:00 to 23:30, the control unit 70 is set to start the compressor 21 and execute the determination mode. Upon determining that the compressor 21 is out of operation for the predetermined time period, the control unit 70 proceeds to step S2.

In step S2, the control unit 70 starts the compressor 21 to start the determination mode.

In step S3, the control unit 70 executes the determination mode after starting the compressor 21.

—Determination Mode—

Figure 3:
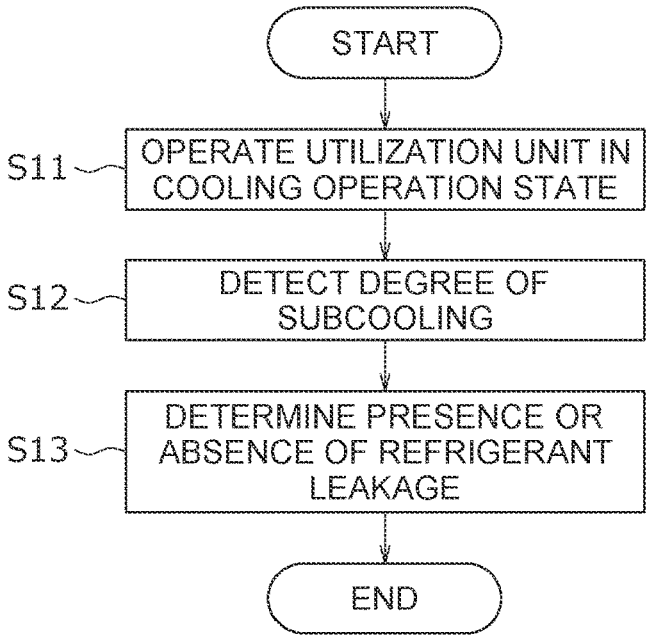
FIG. 3 is a flowchart of the determination mode.

Next, the determination mode executed by the control unit 70 will be described with reference to the flowchart in FIG. 3.

<Step 11: Operation of Utilization Unit in Cooling Operation State>

First, the control unit 70 switches the four-way switching valve 22 of the heat source unit 2 to the state (cooling operation state) indicated by the solid lines in FIG. 1, opens the expansion valve 35 of the heat source unit 2, and starts the compressor 21, the heat source fan 27, and the utilization fan 47.

The control unit 70 causes the utilization fan 47 to operate at a fan rotational speed at which the airflow rate becomes medium or less among the selectable utilization fan taps. For example, but not limited to, the fan tap L is used among the fan taps H. HM, M. LM, and L. However, for the utilization fan 47, for example, the fan tap M or the fan tap LM among the selectable utilization fan taps may be used.

The indoor control unit 47 causes the utilization fan 47 to operate at or below an intermediate rotational speed between a first rotational speed and a second rotational speed. The rotational speed of the utilization fan 47 is preferably set to a rotational speed equal to or less than ⅓ on the second rotational speed side between the first rotational speed and the second rotational speed. Alternatively, the rotational speed of the utilization fan 47 may be the second rotational speed (minimum rotational speed) or may be a rotational speed less than the second rotational speed.

<Step S12: Detection of Degree of Subcooling>

Next, the outdoor control unit 32 detects the degree of subcooling at the outlet of the heat source-side heat exchanger 23 after operating for a predetermined time period.

In the present embodiment, the degree of subcooling of the refrigerant at the outlet of the heat source-side heat exchanger 23 is detected by subtracting the refrigerant temperature value detected by the liquid-side temperature sensor 31 from the refrigerant temperature value detected by the heat exchange temperature sensor 30, or is detected by converting the discharge pressure value of the compressor 21 detected by the discharge pressure sensor 29 into a refrigerant saturation temperature value and subtracting the refrigerant temperature value detected by the liquid-side temperature sensor 31 from the refrigerant saturation temperature value.

<Step S13: Determination of Presence or Absence of Refrigerant Leakage>

Next, the control unit 70 determines the presence or absence of refrigerant leakage from the value of the degree of subcooling detected in step S12.

Specifically, if the subcooling degree value detected in step S12 is almost the same as a target subcooling degree value (for example, the difference between the detected subcooling degree value and the target subcooling degree value is less than a predetermined value), the control unit 70 determines that there is no refrigerant leakage from the refrigerant circuit 10.

Meanwhile, if the subcooling degree value detected in step S12 is smaller than the target subcooling degree value (for example, the difference between the detected subcooling degree value and the target subcooling degree value is a predetermined value or more), the control unit 70 determines that a refrigerant leak from the refrigerant circuit 10 has occurred.

(5) Refrigerant Leakage Determination System

Figure 6:
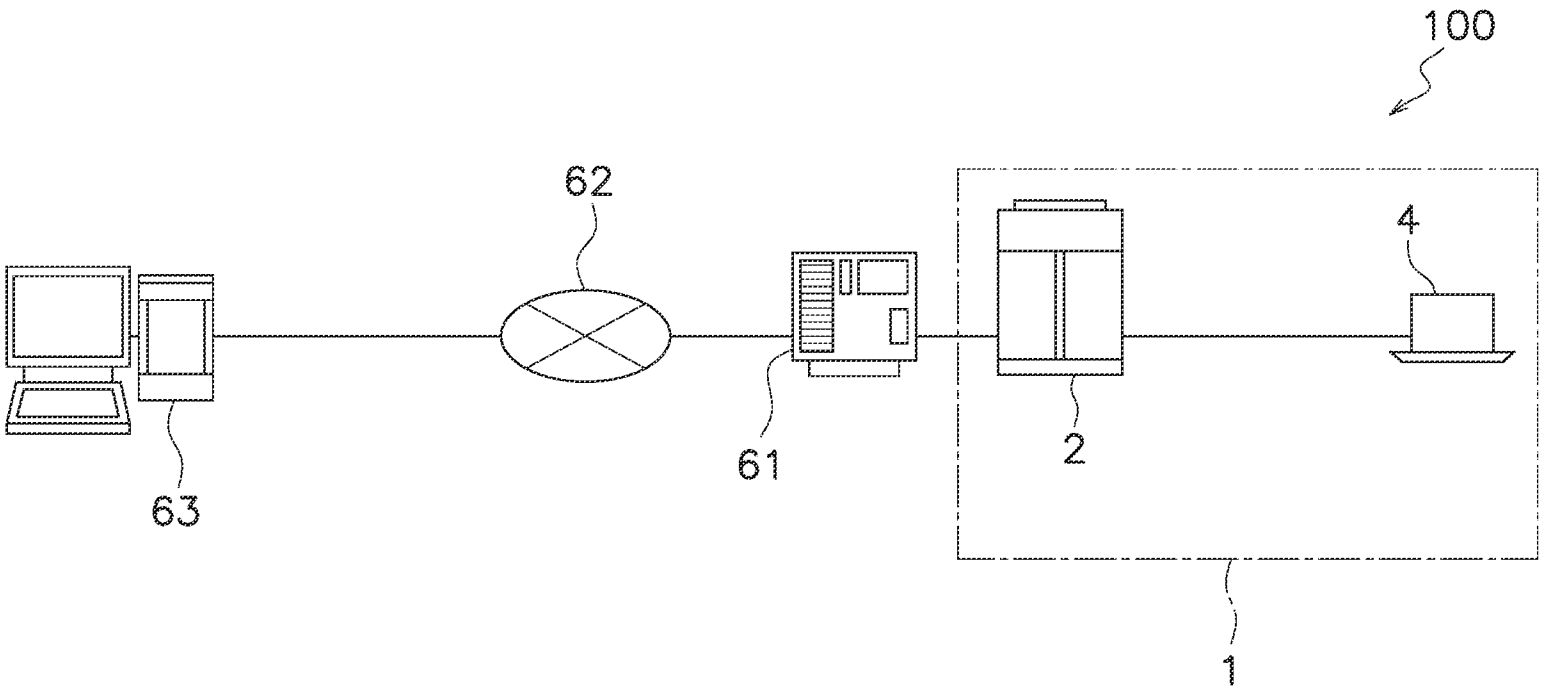
FIG. 6 is a block diagram of a remote monitoring system of the air conditioner.

Next, a refrigerant leakage determination system 100 will be described with reference to FIG. 6.

The refrigerant leakage determination system 100 includes the air conditioner 1, a management device 61, and a remote monitoring server 63. The management device 61 is connected to the control unit 70 of the air conditioner 1 via a communication line. The management device 61 is provided, for example, in the same building as the air conditioner 1. The remote monitoring server 63 is communicably connected to the management device 61 via a network 62.

The control unit 70 transmits various operation data of the air conditioner 1 to the management device 61. The management device 61 transmits predetermined information including the result of the determination mode among the information received from the control unit 70, to the remote monitoring server 63 via the network 62. The remote monitoring server 63 notifies an administrator of the air conditioner 1 as necessary on the basis of the information received from the management device 61.

The remote monitoring server 63 accumulates the determination results of the determination mode of the air conditioner 1. The control unit 70 of the air conditioner 1 transmits the determination results of the determination mode to the management device 61 immediately after the end of the determination mode or after a predetermined time period. The management device 61 periodically transmits the predetermined information, including the results of the determination mode, to the remote monitoring server 63.

Note that in the air conditioner 1, there is a possibility that refrigerant leakage may occur together with other abnormalities such that operation can be continued. In such a case, in order to prevent the failure to notify the remote monitoring server 63 of the results of the determination mode, the management device 61 preferably transmits the results of the determination mode to the remote monitoring server 63 with a higher priority.

Furthermore, the control unit 70 of the air conditioner 1, or the management device 61 preferably holds the results of the determination mode for a certain time period so that the operation results of the refrigerant leakage detection are reliably transmitted to the remote monitoring server 63. The time period during which the determination mode results are held in the control unit 70 or the management device 61 may be set in consideration of the access interval between the remote monitoring server 63 and the management device 61.

(6) Features (6-1)

The air conditioner 1 according to the present embodiment has the heat source unit 2 and the utilization unit 4, and includes the refrigerant circuit 10, the discharge pressure sensor 29, the heat exchange temperature sensor 30, the liquid-side temperature sensor 31, and the control unit 70. The refrigerant circuit 10 is configured by the compressor 21, the condenser, the expansion mechanism 35, and the evaporator being connected by a refrigerant pipe. The discharge pressure sensor 29, the heat exchange temperature sensor 30, and the liquid-side temperature sensor 31 detect the temperature or pressure of refrigerant in the refrigerant circuit 10. The control unit 70 starts the compressor 21 during the non-operation of the compressor 21 and executes a determination mode to determine the presence or absence of refrigerant leakage from the refrigerant circuit 10 on the basis of the detection values of the discharge pressure sensor 29, the heat exchange temperature sensor 30, and the liquid-side temperature sensor 31.

Conventional methods for determining the presence or absence of refrigerant leakage on the basis of changes in refrigerant pressure or temperature during an operation stop have the problem of poor accuracy. In contrast, the air conditioner 1 according to the present embodiment starts the stopped compressor 21 to determine the presence or absence of refrigerant leakage, thereby enabling highly accurate refrigerant leakage determination.

(6-2)

In the air conditioner 1 according to the present embodiment, the control unit 70 executes the determination mode if the compressor 21 has not been operated for a predetermined time period.

This air conditioner 1 enables highly accurate refrigerant leakage determination even if the compressor 21 has not been operated for a predetermined time period, such as in seasons when the air conditioner 1 is not used frequently.

(6-3)

In the air conditioner 1 according to the present embodiment, the utilization unit 4 has the utilization fan 47. The utilization fan 47 can be set to operate in a rotational speed range between a first rotational speed and a second rotational speed. When executing the determination mode, the control unit 70 causes the utilization fan 47 to operate at or below an intermediate rotational speed between the first rotational speed and the second rotational speed.

With the air conditioner 1, when the utilization fan 47 is operated to determine the presence or absence of refrigerant leakage, even if the temperature of the air blown from the indoor unit 4 is not appropriate for a person in the room, a decrease in the comfort of the person in the room can be suppressed.

(6-4)

The refrigerant leakage determination system 100 according to the present embodiment includes the air conditioner 1 and the remote server 63. The air conditioner 1 is the air conditioner 1 according to the present embodiment. The remote server 63 accumulates the determination results of the determination mode of the air conditioner 1. The control unit 70 transmits the determination results of the determination mode to the remote server 63.

In the refrigerant leakage determination system 100, the determination results of the determination mode of the air conditioner 1 are transmitted to the remote server 63, which can store the determination results.

(7) Modifications (7-1) Modification 1A

In the above embodiment, the case where the control unit 70 detects the degree of subcooling at the outlet of the heat source-side heat exchanger 23 using the heat exchange temperature sensor 30 or the discharge pressure sensor 29 and the liquid-side temperature sensor 31 in the determination mode has been described. However, the present disclosure is not limited to this.

Furthermore, in the determination mode according to the above embodiment, the control unit 70 causes the air conditioner 1 to perform the cooling operation, but is not limited thereto, and may cause the air conditioner 1 to perform the heating operation. Furthermore, the control unit 70 may perform special operation to determine the presence or absence of refrigerant leakage from the refrigerant circuit.

Moreover, an index other than the degree of subcooling may be used to detect refrigerant leakage.

For example, the suction pressure sensor 28 may be used to detect the suction pressure, and if the suction pressure is lower than a normal value, it may be determined that a refrigerant leak is occurring.

Also, the discharge pressure sensor 29 may be used to detect the discharge pressure, and if the discharge pressure is lower than a normal value, it may be determined that a refrigerant leak is occurring.

Also, the gas-side temperature sensor 44, the liquid-side temperature sensor 43, and the suction pressure sensor 28 may be used to detect the degree of suction superheating, and if the degree of suction superheating is greater than a normal value, it may be determined that a refrigerant leak is occurring.

Also, the gas-side temperature sensor 44 may be used to detect the discharge gas refrigerant temperature, and if the discharge gas refrigerant temperature is higher than a normal value, it may be determined that a refrigerant leak is occurring.

Also, an indoor temperature sensor 46 may be used to detect the temperature difference between the suction air temperature and the blow-out air temperature, and if the temperature difference between the suction air temperature and the blow-out air temperature is smaller than a normal value, it may be determined that a refrigerant leak is occurring.

Also, a float valve (not illustrated) may be used to detect the liquid level height of a receiver (not illustrated), and if the liquid level height of the receiver is less than a normal value, it may be determined that a refrigerant leak is occurring.

Furthermore, if the air conditioner has a water-cooled condenser, a cold water temperature sensor (not illustrated) may be used to detect the temperature difference between the chilled water inlet temperature and the chilled water outlet temperature, and if the temperature difference between the chilled water inlet temperature and the chilled water outlet temperature is smaller than a normal value, it may be determined that a refrigerant leak is occurring.

(7-2) Modification 1B

When detecting refrigerant leakage by forcibly operating the compressor 21 that is out of operation, the compressor 21 may be operated for only a short period of time. This is because the operation of the compressor 21 performed to detect refrigerant leakage during the non-operation of the compressor 21 is not desired by the user and is therefore preferably completed in a short time. The short time is, for example, several tens of seconds.

In this determination mode, the presence or absence of refrigerant leakage may be determined on the basis of, for example, whether the temperature of the refrigerant changes in the heat source-side heat exchanger 23 or the utilization-side heat exchanger 42.

However, for example, in the method for determining the presence or absence of refrigerant leakage depending on whether the temperature of the refrigerant changes in the heat source-side heat exchanger 23 or the utilization-side heat exchanger 42, the change in the temperature of the refrigerant is observed in a short time, and thus the method is easily affected by the outdoor temperature and the indoor temperature. Therefore, the control unit of the air conditioner may determine the presence or absence of refrigerant leakage from the refrigerant circuit further on the basis of the ambient temperature around the heat source unit detected by the outdoor temperature sensor or the ambient temperature around the utilization unit detected by the indoor temperature sensor.

Figure 4:
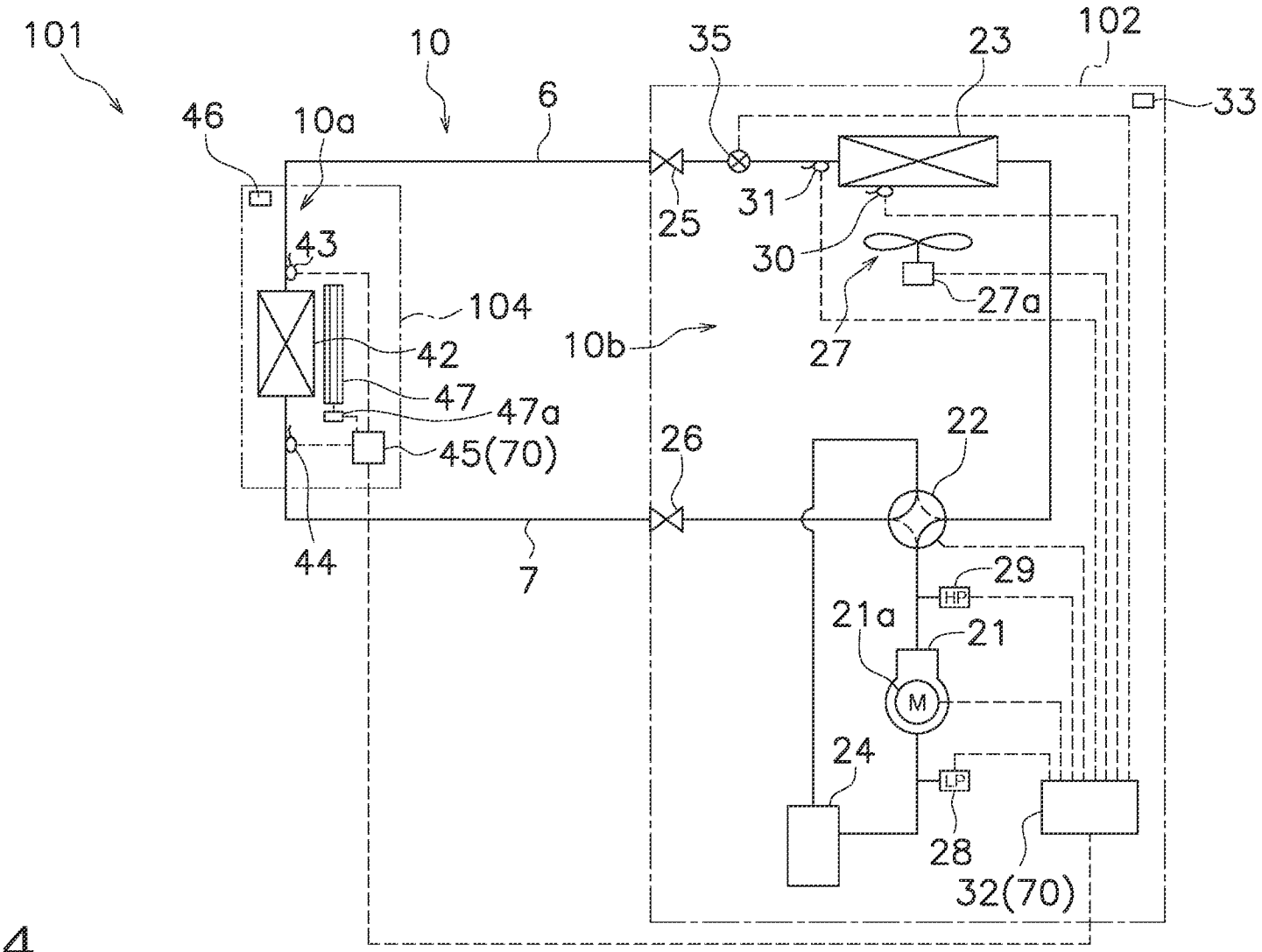
FIG. 4 is a schematic refrigerant circuit diagram of an air conditioner according to another example.

FIG. 4 is a schematic refrigerant circuit diagram of an air conditioner 101 according to Modification 1B. In the air conditioner 101, a utilization unit 104 is provided with the indoor temperature sensor 46 that detects an indoor temperature. Furthermore, the heat source unit 102 is provided with an outdoor temperature sensor 33 that detects an outdoor temperature. The outdoor temperature sensor 33 exemplifies a second detector in the claims, which detects the ambient temperature around the heat source unit 102. Furthermore, the indoor temperature sensor 46 exemplifies a second detector in the claims, which detects the ambient temperature around the utilization unit 104. The configuration of the air conditioner 101 other than the indoor temperature sensor 46 and the outdoor temperature sensor 33 is similar to that of the air conditioner 1 described in the present embodiment, and thus detailed description thereof is omitted.

The air conditioner according to Modification 1B allows refrigerant leakage determination with relatively high accuracy even if the air conditioner 1 is operated only for a short time, on the basis of the outdoor temperature or the indoor temperature in addition to the temperature or pressure of the refrigerant flowing through the refrigerant circuit.

(7-3) Modification 1C

When starting the compressor 21 to determine the presence or absence of refrigerant leakage during the non-operation of the compressor 21, the control unit 70 may execute the determination mode in further consideration of the presence or absence of a person in a space to be air-conditioned by the air conditioner 1.

Figure 5:
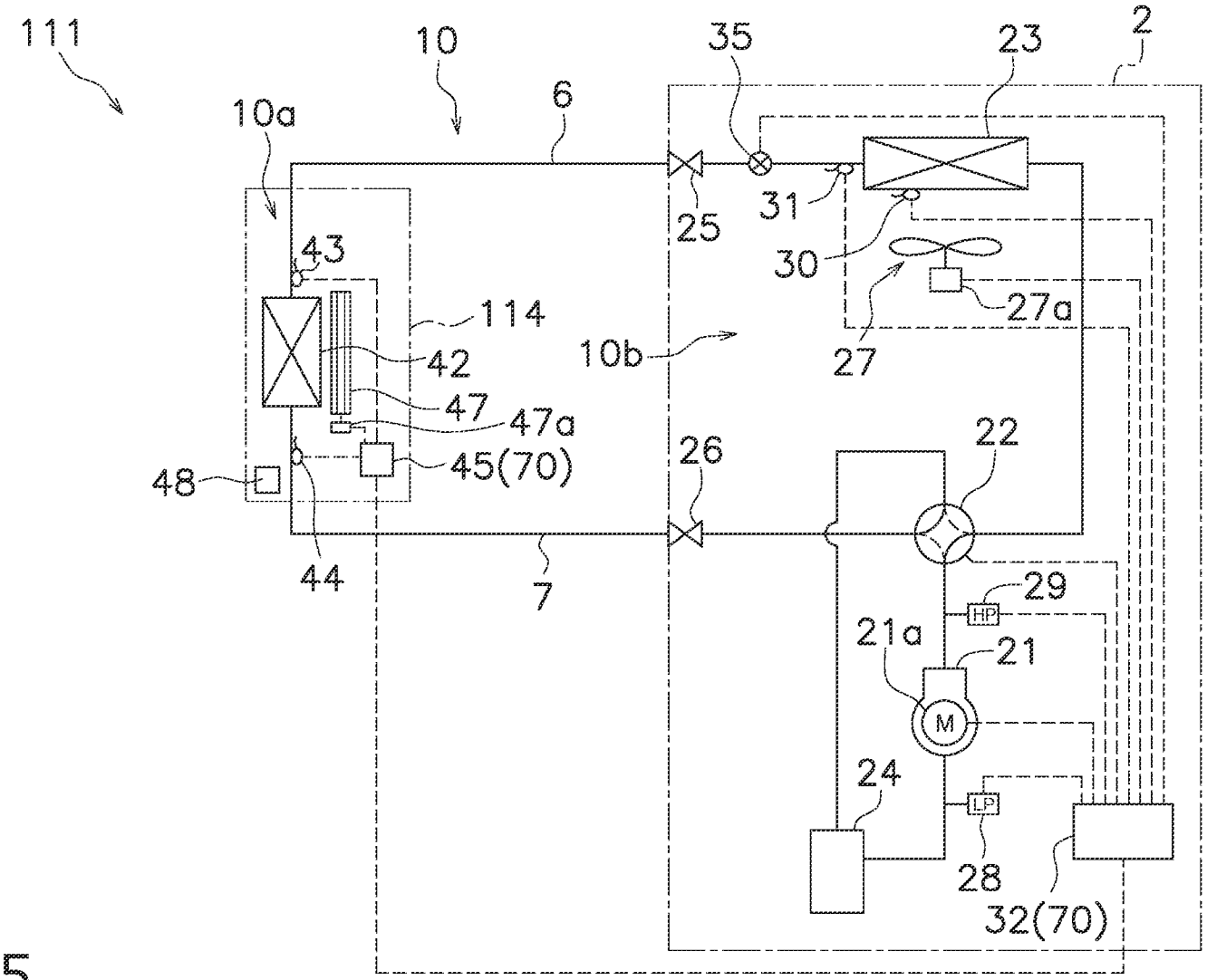
FIG. 5 is a schematic refrigerant circuit diagram of an air conditioner according to another example.

FIG. 5 is a schematic refrigerant circuit diagram of an air conditioner 111 according to Modification 1C. In the air conditioner 111, a utilization unit 114 includes a presence sensor 48. The presence sensor 48 detects the presence or absence of a person in a space to be air-conditioned by the air conditioner 111. The control unit 70 of the air conditioner 1 executes the determination mode if the presence sensor 48 determines that there is no person in the space to be air-conditioned. The configuration of the air conditioner 1/1 other than the presence sensor 48 is similar to that of the air conditioner 1 described in the present embodiment, and thus a detailed description thereof will be omitted.

However, regardless of the presence or absence of a person in the space to be air-conditioned by the air conditioner 1, the presence or absence of refrigerant leakage is preferably determined once in a predetermined period (for example, once a day).

In the air conditioner 1 according to Modification 1C, since the air conditioner 1 is operated when there is no person in the room, the presence or absence of refrigerant leakage can be determined without affecting the comfort of the user.

(7-4) Modification 1D

In the air conditioner 101 illustrated in FIG. 4, when starting the compressor 21 to determine the presence or absence of refrigerant leakage during the non-operation of the compressor 21, the control unit 70 may execute the determination mode if the temperature of a first space to be air-conditioned by the air conditioner 101 falls within a predetermined range. The predetermined range of the temperature of the first space to be air-conditioned falls within the set temperature range of the air conditioner 101. The set temperature range of the air conditioner 101 is, for example, the range from 20° C. to 25° C. when the set temperature is set at 25° C. for cooling operation, and the range from 20° C. to 30° C. when the set temperature is set at 20° C. for heating operation.

Furthermore, the control unit 70 may terminate the determination mode if the temperature of the first space falls outside the predetermined range due to the execution of the determination mode.

The control unit 70 may also terminate the determination mode if the temperature of the first space rises or falls by a predetermined temperature, even within the predetermined range, due to the execution of the determination mode. For example, in a case where operation is performed in the cooling operation state during the determination mode, the determination mode is ended when the temperature of the first space to be air-conditioned by the air conditioner 101 rises by, for example, 3 degrees Celsius from the start of the determination mode. In addition, for example, in a case where operation is performed in a heating operation state during the determination mode, the determination mode is ended when the temperature of the first space to be air-conditioned by the air conditioner 101 drops by, for example, 3 degrees Celsius from the start of the determination mode.

However, it is preferable to determine the presence or absence of refrigerant leakage once in a predetermined period (for example, once a day) even if the temperature of the first space falls outside the predetermined range or rises or falls by a predetermined temperature or more due to the execution of the determination mode.

The air conditioner 101 according to Modification 1D has the same configuration as the air conditioner 101 described in Modification 1B.

In the air conditioner 101 according to Modification 1D, the determination mode is executed when the user is in the comfortable state, so that it is possible to determine the presence or absence of refrigerant leakage with minimal impact on the comfort of the user.

(7-5) Modification 1E

In the air conditioner 101 illustrated in FIG. 4, when starting the compressor 21 to determine the presence or absence of refrigerant leakage during the non-operation of the compressor 21, the control unit 70 may execute the determination mode if the thermal index of the first space to be air-conditioned by the air conditioner 101 falls within a predetermined range. For example, the control unit 70 may execute the determination mode if the discomfort index of the first space to be air-conditioned by the air conditioner 101 is 65 or more during the heating operation or 75 or less during the cooling operation. The discomfort index is obtained by the formula "0.81×room temperature+0.01×humidity×(0.99×room temperature −14.3)+46.3".

The control unit 70 may also terminate the determination mode if the thermal index of the first space falls outside the predetermined range due to the execution of the determination mode.

The control unit 70 may also terminate the determination mode if the thermal index of the first space rises or falls by a predetermined temperature, even within the predetermined range, due to the execution of the determination mode.

However, it is preferable to determine the presence or absence of refrigerant leakage once in a predetermined period (for example, once a day) even if the thermal index of the first space falls outside the predetermined range or rises or falls by a predetermined temperature or more due to the execution of the determination mode.

The air conditioner 101 according to Modification 1E has the same configuration as the air conditioner 101 described in Modification 1B.

In the air conditioner 101 according to Modification 1E, the determination mode is executed when the user is in the comfortable state, so that it is possible to determine the presence or absence of refrigerant leakage with minimal impact on the comfort of the user.

(7-6) Modification 1F

After executing the determination mode while performing cooling operation and using the utilization-side heat exchanger 42 as an evaporator, the control unit 70 may stop the compressor 21 and execute drying operation to dry the utilization-side heat exchanger 42 with the utilization fan 47.

In the air conditioner according to Modification 1F, even if the utilization-side heat exchanger (evaporator) 42 gets wet due to the cooling operation while the air conditioner 1 is stopped, the evaporator 42 can be dried by executing the drying operation after the completion of the determination mode.

Alternatively, after executing the determination mode while performing heating operation and using the heat source-side heat exchanger 23 as an evaporator, the control unit 70 may stop the compressor 21 and execute drying operation to dry the heat source-side heat exchanger 23 with the heat source fan 27. Even if the heat source-side heat exchanger (evaporator) 23 gets wet due to the heating operation while the air conditioner 1 is stopped, the heat source-side heat exchanger 23 can be dried using the heat source fan 27 after the execution of the determination mode.

(7-7) Modification 1G

When starting the compressor 21 to determine the presence or absence of refrigerant leakage during the non-operation of the compressor 21, the control unit 70 may execute the determination mode simultaneously with the cleaning operation for cleaning the air conditioner 1. In the cleaning operation for cleaning the air conditioner 1, the heating operation is performed after the cooling operation. By drying the inside of the indoor unit 4, the generation of mold can be suppressed.

In the air conditioner according to Modification 1G, the determination mode can be executed simultaneously with the cleaning operation during the non-operation of the compressor.

(7-8) Modification 1H

When starting the compressor 21 to determine the presence or absence of refrigerant leakage during the non-operation of the compressor 21, the control unit 70 may execute the determination mode in the operation state of the air conditioner 1 set before the compressor 21 is stopped. For example, if the operating mode set before the compressor 21 is stopped is the heating operation, the control unit 70 may determine the presence or absence of refrigerant leakage during the heating operation.

Since the air conditioner according to Modification 1I, during the determination mode, operates in the set operation state of the air conditioner, the determination mode can be executed with minimal impact on the comfort of the user.

(7-9) Modification 1I

In the air conditioner 101 illustrated in FIG. 4, when starting the compressor 21 to determine the presence or absence of refrigerant leakage during the non-operation of the compressor 21, the control unit 70 may switch the operation states of the air conditioner 1 on the basis of the outdoor temperature or the indoor temperature. When starting the compressor during the non-operation of the compressor 21, the control unit 70 may execute the determination mode in the operation state of the air conditioner 101 set before the compressor 21 is stopped. However, if the outdoor temperature or the indoor temperature falls outside the allowable range of the set operation state, the pressure of the refrigerant circuit 10 could increase and overload the compressor 21.

Therefore, if the operation state set by the air conditioner 101 is the heating operation state and the outdoor temperature or the indoor temperature is not within the range of the set temperature (operable temperature) of the operation state, the control unit 70 may switch the state of the refrigerant circuit 10 to the cooling operation state and execute the determination mode.

In the air conditioner according to Modification 1I, if the outdoor temperature or the indoor temperature is not within the range of the set temperature of the heating operation state even when the operation state set in the air conditioner is the heating operation state, the load on the compressor 21 can be reduced by switching to the cooling operation and executing the determination mode.

The air conditioner 101 according to Modification 1I has the same configuration as the air conditioner 101 described in Modification 1B.

(7-10) Modification 1J

In the present embodiment, the air conditioner capable of switching between cooling and heating has been described, but the present disclosure is not limited thereto. An air conditioner dedicated to cooling may be used. Alternatively, the refrigeration cycle device may be a refrigeration cycle device other than the air conditioner, and may be, for example, a freezing/refrigerating unit, a heat pump water heater, or a water chilling unit.

(7-11) Modification 1K

In the present embodiment, the control unit 70 of the air conditioner 1 determines the presence or absence of refrigerant leakage, but the management device 61 or the remote monitoring server 63 of the refrigerant leakage determination system 100 may determine the presence or absence of refrigerant leakage. In a case where the control unit 70 starts the compressor 21 to determine the presence or absence of refrigerant leakage while the compressor 21 is stopped, the control unit 70 acquires various operation data of the air conditioner 1 and transmits the operation data to the management device 61 or the remote monitoring server 63. The management device 61 or the remote monitoring server 63 determines the presence or absence of refrigerant leakage on the basis of the acquired various operation data of the air conditioner 1. Note that the refrigerant leakage determination system 100 may be configured without the management device 61. In this case, the control unit 70 of the air conditioner 1 may directly transmit various data to the remote monitoring server 63, and the remote monitoring server 63 may determine the presence or absence of refrigerant leakage.

(7-12) Modification 1L

The embodiment of the present disclosure has been described above, and it will be understood that various changes in form and detail are possible without departing from the spirit and scope of the present disclosure recited in the claims.

REFERENCE SIGNS LIST

1, 101, 111: air conditioner (refrigeration cycle device)
2, 102: heat source unit
4, 104, 114: utilization unit
6: liquid-refrigerant connection pipe
7: gas-refrigerant connection pipe
10: refrigerant circuit
21: compressor
21*a*: motor
22: four-way switching valve (switching mechanism)
23: heat source-side heat exchanger
24: accumulator
27: heat source fan
27*a*: fan motor
28: suction pressure sensor (first detector)
29: discharge pressure sensor (first detector)
30: heat exchange temperature sensor (first detector)
31: liquid-side temperature sensor (first detector)

32: heat source-side control unit (control unit)
33: outdoor temperature sensor (second detector)
35: expansion valve (expansion mechanism)
42: utilization-side heat exchanger
43: liquid-side temperature sensor (first detector)
44: gas-side temperature sensor (first detector)
45: utilization-side control unit (control unit)
46: indoor temperature sensor (second detector)
47: utilization fan
47*a*: fan motor
48: presence sensor
63: remote server (server)
70: control unit
100: remote management system (refrigerant leakage determination system)

CITATION LIST

Patent Literature

Patent Literature 1: JP 6257801 B2

The invention claimed is:

1. A refrigeration cycle device having a heat source unit and a utilization unit, the refrigeration cycle device comprising:

a refrigerant circuit that is configured by a compressor, a condenser, an expansion mechanism, and an evaporator being connected by a refrigerant pipe;

a first detector that detects a temperature or a pressure of refrigerant in the refrigerant circuit; and a controller that starts the compressor during non-operation of the compressor and executes a determination mode to determine presence or absence of refrigerant leakage from the refrigerant circuit on the basis of a detection value of the first detector, wherein the utilization unit has a utilization fan, the utilization fan can be set to operate in a rotational speed range between a first rotational speed and a second rotational speed, and when executing the determination mode as initiated from a state of non-operation of the compressor, the controller causes the utilization fan to operate during the determination mode at or below an intermediate rotational speed between the first rotational speed and the second rotational speed.

2. The refrigeration cycle device according to claim 1, wherein the controller executes the determination mode if the compressor has not been operated for a predetermined time period.

3. The refrigeration cycle device according to claim 1, wherein the refrigeration cycle device is an air conditioner.

4. The refrigeration cycle device according to claim 3, further comprising a second detector that detects an ambient temperature around the heat source unit or an ambient temperature around the utilization unit, wherein the controller determines the presence or absence of refrigerant leakage from the refrigerant circuit further on the basis of the ambient temperature around the heat source unit or the ambient temperature around the utilization unit.

5. The refrigeration cycle device according to claim 3, further comprising a presence sensor that is installed in a first space to be air-conditioned by the refrigeration cycle device and detects presence or absence of a person in the first space, wherein the controller executes the determination mode if the presence sensor determines that there is no person in the first space.

6. The refrigeration cycle device according to claim 3, wherein the controller executes the determination mode if a temperature or a thermal index of a first space to be air-conditioned by the refrigeration cycle device falls within a predetermined range.

7. The refrigeration cycle device according to claim 3, wherein the utilization unit has a heat exchanger and the utilization fan, and after executing the determination mode while using the heat exchanger as an evaporator, the controller stops the compressor, and executes drying operation to dry the heat exchanger with the utilization fan.

8. The refrigeration cycle device according to claim 3, wherein the controller executes the determination mode simultaneously with cleaning operation for cleaning the refrigeration cycle device.

9. The refrigeration cycle device according to claim 3, wherein the refrigeration cycle device can switch an operation state between cooling operation and heating operation, and the controller executes the determination mode in the operation state of the refrigeration cycle device set before the compressor is stopped.

10. A refrigerant leakage determination system comprising:

the refrigeration cycle device according to claim 1; and a server that accumulates determination results of the determination mode of the refrigeration cycle device, wherein the controller transmits the determination results of the determination mode to the server.

11. The refrigeration cycle device according to claim 2, wherein the refrigeration cycle device is an air conditioner.

12. The refrigeration cycle device according to claim 4, further comprising a presence sensor that is installed in a first space to be air-conditioned by the refrigeration cycle device and detects presence or absence of a person in the first space, wherein the controller executes the determination mode if the presence sensor determines that there is no person in the first space.

13. The refrigeration cycle device according to claim 4, wherein the controller executes the determination mode if a temperature or a thermal index of a first space to be air-conditioned by the refrigeration cycle device falls within a predetermined range.

14. The refrigeration cycle device according to claim 5, wherein the controller executes the determination mode if a temperature or a thermal index of a first space to be air-conditioned by the refrigeration cycle device falls within a predetermined range.

15. The refrigeration cycle device according to claim 4, wherein the controller executes the determination mode simultaneously with cleaning operation for cleaning the refrigeration cycle device.

* * * * *